US010199137B2

(12) United States Patent
Ushiwata et al.

(10) Patent No.: US 10,199,137 B2
(45) Date of Patent: Feb. 5, 2019

(54) INSULATED WIRE AND COIL USING THE SAME

(71) Applicant: Hitachi Metals, Ltd.

(72) Inventors: Takami Ushiwata, Hitachi (JP); Yuki Honda, Hitachi (JP); Shuta Nabeshima, Hitachi (JP); Hideyuki Kikuchi, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 736 days.

(21) Appl. No.: 14/012,210

(22) Filed: Aug. 28, 2013

(65) Prior Publication Data

US 2014/0065421 A1 Mar. 6, 2014

(30) Foreign Application Priority Data

Sep. 3, 2012 (JP) ..... 2012-193046

(51) Int. Cl.
*H01B 3/30* (2006.01)

(52) U.S. Cl.
CPC ..... *H01B 3/306* (2013.01); *Y10T 428/2969* (2015.01)

(58) Field of Classification Search
USPC ..... 174/110 SR, 120 SR; 428/379, 395
See application file for complete search history.

(56) References Cited

U.S. PATENT DOCUMENTS

| | | | | |
|---|---|---|---|---|
| 4,568,715 | A * | 2/1986 | Itatani | C08G 73/1032 524/323 |
| 2012/0231264 | A1* | 9/2012 | Auman | C08G 73/1042 428/329 |
| 2013/0000951 | A1* | 1/2013 | Honda | H01B 3/308 174/120 SR |
| 2013/0098656 | A1 | 4/2013 | Saito et al. | |
| 2013/0161061 | A1* | 6/2013 | Honda | H01B 3/308 174/110 SR |
| 2014/0102752 | A1* | 4/2014 | Ushiwata | H01B 3/306 174/110 SR |

FOREIGN PATENT DOCUMENTS

| | | |
|---|---|---|
| JP | 09-106715 | 4/1997 |
| WO | 2011063238 A1 | 5/2011 |
| WO | 2013136807 | 9/2013 |

OTHER PUBLICATIONS

JP office Action dated Dec. 9, 2014 and English translation thereof.
Chinese Office Action for application No. 201310395113.1 dated Feb. 3, 2016 and English translation.
Chinese Office Action for corresponding Chinese Patent Application No. 201310395113.1 dated Sep. 23, 2016 and English translation thereof.
Chinese Patent Office Action Application No. 201310395113.1 dated Dec. 20, 2016 and English translation thereof.

* cited by examiner

*Primary Examiner* — Lynda Salvatore
(74) *Attorney, Agent, or Firm* — Roberts Mlotkowski Safran Cole & Calderon, P.C.

(57) ABSTRACT

An insulated wire includes a conductor, and a polyimide insulation layer formed on an outer periphery of the conductor. The insulation layer includes a polyimide including a repeating unit represented by formula (1) and a repeating unit represented by formula (2). A first acid component in the repeating unit represented by the formula (1) and a second acid component in the repeating unit represented by the formula (2) are mixed in a molar ratio range of 85:15 to 40:60 as expressed by a molar ratio (the first acid component:the second acid component). R as a residue of a diamine component in the formulas (1) and (2) includes a residue of 4,4'-diaminodiphenyl ether and a residue of one selected from a group of diamines represented by the formulas (3) to (8). A storage elastic modulus of the polyimide at 325° C. is not less than 50 MPa.

9 Claims, No Drawings

INSULATED WIRE AND COIL USING THE SAME

The present application is based on Japanese patent application No. 2012-193046 filed on Sep. 3, 2012, the entire contents of which are incorporated herein by reference.

BACKGROUND OF THE INVENTION

1. Field of the Invention

The invention relates to an insulated wire and a coil using the same. In more detail, the invention relates to an insulated wire excellent in partial discharge resistance and high temperature processability, and a coil using the same.

2. Description of the Related Art

An insulated wire having an insulation layer (an insulating film) excellent in mechanical characteristics, heat resistance and solvent resistance has been proposed in which a polyimide synthesized from, e.g., pyromellitic dianhydride (PMDA) and 4,4'-diaminodiphenyl ether (ODA) is used for the insulation layer (see, e.g., JP-A 9-106712).

In recent years, industrial motors have been reduced in size and weight. In addition, inverter drive for improving dynamic performance, together with high voltage drive for high power output, is being developed rapidly.

Since the motor is driven at high voltage and at the same time is inverter-driven, the overlapping of the high voltage drive with the inverter drive increases the risk of partial discharge occurrence in an insulated wire of the motor. In an insulated wire with a low partial discharge inception voltage (PDIV), partial discharge is likely to occur at lower voltage and an insulation layer is gradually eroded due to the partial discharge occurred therein, which eventually causes insulation failure.

The PDIV of the insulated wire can be improved by increasing a film thickness of the insulation layer and decreasing the relative permittivity of the insulation layer. For high-power motors, a PDIV at a film thickness of 40 μm is needed to be not less than 900 Vp.

In case that the above-mentioned insulated wire having an insulation layer formed of a polyimide is used in such a high-power motor, the above-mentioned PDIV level may not be satisfied since the polyimide has relatively high relative permittivity and it is therefore necessary to increase a film thickness to manage to improve the PDIV. However, use of a thick insulation layer decreases a space factor of a conductor in a motor and this makes the motor difficult to output high power.

SUMMARY OF THE INVENTION

The relative permittivity of the insulation layer can be decreased by reducing the concentration of a high-polarity functional group in the insulation layer. In the case of the polyimide whose imide group is a high-polarity functional group, the concentration of the imide group may be reduced by using a high-molecular-weight diamine and dianhydride as raw materials of the polyimide so as to allow a decrease in permittivity.

However, reducing the imide group in the polyimide may cause a decrease in mechanical strength. Deformation and expansion, etc., are likely to occur especially during a high temperature process such as welding. Therefore, an insulation layer is demanded that can suppress the deformation and expansion, etc., during the high temperature process.

It is an object of the invention to provide an insulated wire excellent in partial discharge resistance and high temperature processability, as well as a coil using the insulated wire.

As a result of intense study to achieve the above-mentioned object, the inventors have found that the incorporation of a specific structure into a polyimide so as to provide a high storage elastic modulus at high temperature provides an insulated wire with a polyimide insulation layer to have a high partial discharge inception voltage and to be less likely to deform or expand during the high temperature process. Thereby the invention was completed.

In detail, it was found that introduction of 3,3',4,4'-biphenyltetracarboxylic dianhydride (s-BPDA) having a biphenyl group into a polyimide composed of PMDA and ODA and use of another diamine component in addition to ODA achieve improvement in PDIV and a storage elastic modulus at high temperature which normally decreases with an increase in temperature can be kept high also by introduction of s-BPDA, and thereby the invention was completed.

(1) According to one embodiment of the invention, an insulated wire comprises:

a conductor, and a polyimide insulation layer formed on an outer periphery of the conductor, wherein the insulation layer comprises a polyimide comprising a repeating unit represented by the following formula (1) and a repeating unit represented by the following formula (2), wherein a first acid component in the repeating unit represented by the formula (1) and a second acid component in the repeating unit represented by the formula (2) are mixed in a molar ratio range of 85:15 to 40:60 as expressed by a molar ratio (the first acid component:the second acid component), wherein R as a residue of a diamine component in the formulas (1) and (2) comprises a residue of 4,4'-diaminodiphenyl ether and a residue of one selected from a group of diamines represented by the following formulas (3) to (8), and wherein a storage elastic modulus of the polyimide at 325° C. is not less than 50 MPa.

(1)

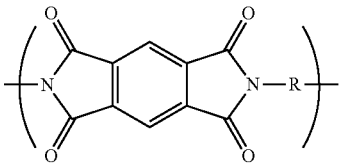

(2)

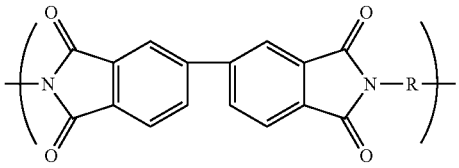

(3)

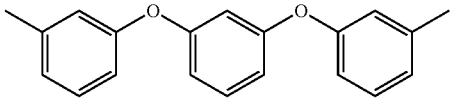

(4)

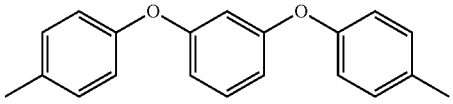

-continued (5)

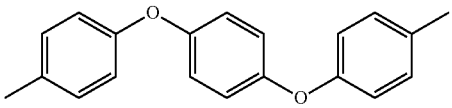

(6)

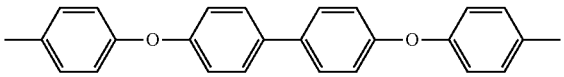

(7)

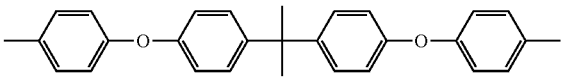

(8)

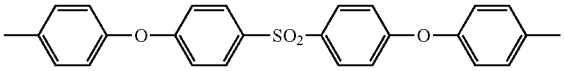

In the above embodiment (1) of the invention, the following modifications and changes can be made.

(i) The residue of 4,4'-diaminodiphenyl ether and the residue of a diamine represented by one of the formulas (3) to (8) are mixed in a molar ratio range of 99:1 to 25:75 as expressed by a molar ratio (the residue of 4,4'-diaminodiphenyl ether:the residue of a diamine represented by one of the formulas (3) to (8)).

(2) According to another embodiment of the invention, a coil comprises the insulated wire according to the embodiment (1).

Effects of the Invention

According to one embodiment of the invention, an insulated wire can be provided that is excellent in partial discharge resistance and high temperature processability, as well as a coil using the insulated wire. Specifically, it may have a high PDIV without substantially increasing the film thickness thereof due to the low relative permittivity and an excellent processability at high temperature due to the high storage elastic modulus at high temperature.

DETAILED DESCRIPTION OF THE PREFERRED EMBODIMENTS

Summary of Embodiment

An insulated wire of the present embodiment is provided with a conductor and a polyimide insulation layer provided on an outer periphery of the conductor, wherein the insulation layer is formed of a polyimide having a repeating unit represented by the formula (1) and a repeating unit represented by the formula (2), a first acid component in the repeating unit represented by the formula (1) and a second acid component in the repeating unit represented by the formula (2) are mixed in a molar ratio range of 85:15 to 40:60, R representing a residue of a diamine component in the formulas (1) and (2) is composed of a residue of 4,4'-diaminodiphenyl ether and a residue of a diamine selected from a group of diamines represented by the formulas (3) to (8), and a storage elastic modulus of the polyimide at 325° C. is not less than 50 MPa.

Embodiment

The embodiment of an insulated wire and a coil using the same according to the invention will be described in detail below.

Insulated Wire

The insulated wire in the present embodiment is an insulated wire provided with a conductor and a polyimide insulation layer provided on an outer periphery of the conductor, and is configured such that the insulation layer is formed of a polyimide having a repeating unit represented by the formula (1) and a repeating unit represented by the formula (2), a first acid component in the repeating unit represented by the formula (1) and a second acid component in the repeating unit represented by the formula (2) are mixed in a molar ratio range of 85:15 to 40:60 as expressed by a molar ratio (the first acid component:the second acid component), R representing a residue of a diamine component in the formulas (1) and (2) is composed of a residue of 4,4'-diaminodiphenyl ether and a residue of a diamine selected from a group of diamines represented by the formulas (3) to (8), and a storage elastic modulus of the polyimide at 325° C. is not less than 50 MPa.

In the present embodiment, it is preferably configured that the residue of 4,4'-diaminodiphenyl ether and the residue of a diamine represented by one of the formulas (3) to (8) are mixed in a molar ratio range of 99:1 to 25:75 as expressed by a molar ratio (the residue of 4,4'-diaminodiphenyl ether: the residue of a diamine represented by one of the formulas (3) to (8)).

A conductor used in the present embodiment can be formed of, e.g., a metal wire such as copper wire or aluminum wire.

The first acid component in the repeating unit represented by the formula (1) includes pyromellitic dianhydride (PMDA). Meanwhile, the second acid component in the repeating unit represented by the formula (2) includes 3,3', 4,4'-biphenyltetracarboxylic dianhydride (s-BPDA).

When a mixture amount of the second acid component as expressed by a molar ratio of the first acid component in the repeating unit represented by the formula (1) to the second acid component in the repeating unit represented by the formula (2) (the first acid component:the second acid component) is less than 85:15 (i.e., when the mixture amount of the second acid component is less than 15 mole %), an effect obtained by introducing the structure of the formula (2) is reduced and a film thickness of the insulation layer is increased to improve the PDIV. On the other hand, when the second acid component in the repeating unit represented by the formula (2) is more than the molar ratio of 40:60 (more than 60 mole %), a molecular structure of polyimide becomes soft, glass-transition temperature (Tg) or a storage elastic modulus at high temperature decreases and thermoplasticity develops. In this case, deformation or expansion of a film and a problem in heat resistance occur during a process at a high temperature which is not less than a temperature range close to Tg. Thus, a molar ratio of the repeating unit represented by the formula (2) needs to be not more than 40:60 (not more than 60 mole %), and preferably, not more than 60:40 (not more than 40 mole %).

A storage elastic modulus of the polyimide at 325° C. needs to be not less than 50 MPa in order to satisfy high temperature processability.

A residue of a diamine component which is expressed by R in the formulas (1) and (2) is composed of a ODA-derived residue and a residue of a diamine selected from a group of diamines represented by the formulas (3) to (8) and these residues are mixed within a molar ratio range of 99:1 to 25:75 as expressed by a molar ratio (the ODA-derived residue:the residue of a diamine represented by one of the formulas (3) to (8)).

The residue, which is derived from other diamine component than ODA and is expressed by R, includes residues of diamine components such as 1,4-bis(4-aminophenoxy) benzene (TPE-Q), 1,3-bis(4-aminophenoxy)benzene (TPE-R), 1,3-bis(3-aminophenoxy)benzene (APB), 4,4'-bis(4-aminophenoxy)biphenyl (BAPB), 2,2-bis[4-(4-aminophenoxy)phenyl]propane (BAPP) and bis[4-(4-aminophenoxy)phenyl]sulfone (BAPS).

The residues of diamine components represented by the formulas (3) to (8) other than ODA have higher molecular weight than the residue of ODA and thus can decrease an imide group concentration when being introduced into a polyimide backbone as compared to the residue of ODA, thereby increasing an effect of decreasing relative permittivity and allowing a high PDIV to be obtained. Especially when using a residue of BAPS, TPE-Q, TPE-R or APB, it is possible to obtain improvement in adhesion to a conductor, in addition to the high PDIV.

In addition, although the storage elastic modulus tends to decrease with an increase in a molar ratio of s-BPDA in polyimide, it is possible to improve the storage elastic modulus by the residue of the other diamine component than ODA.

When a mixture amount of the residue of the other diamine than ODA as expressed by a molar ratio with respect to the residue of ODA (the residue of ODA:the residue of the diamine component other than ODA) is less than 99:1 (i.e., when the mixture amount of the residue of the other diamine component than ODA is less than 1 mole %), an effect of reducing the imide group concentration is small. On the other hand, in case of more than 25:75 (more than 75 mole %), it is possible to reduce the imide group concentration and thus possible to obtain a higher PDIV but characteristics of the diamine component other than ODA may cause a decrease in flexibility or deterioration of heat resistance. A molar ratio of the residue of ODA to the residue of the other diamine component (the residue of ODA:the residue of the other diamine component) is more preferably in a range of 90:10 to 40:60.

When a residue of 2,2-bis[4-(4-aminophenoxy)phenyl] propane (BAPP) is used as the residue of the other diamine component than ODA, a storage elastic modulus of a polyimide to be manufactured may decrease since the residue of BAPP is a monomer including a relatively soft structure having an alkyl group. Therefore, when the residue of BAPP is mixed in an amount more than the residue of ODA (mixed in an amount of more than 50 mole %), a decrease in the storage elastic modulus caused by mixing the residue of BAPP can be suppressed by increasing the mixture amount of PMDA which is the first acid component in the repeating unit represented by the formula (1) (e.g., more than 50 mole % of PMDA).

On the other hand, when a residue of 1,4-bis(4-aminophenoxy)benzene (TPE-Q), 1,3-bis(4-aminophenoxy)benzene (TPE-R), 1,3-bis(3-aminophenoxy)benzene (APB), 4,4'-bis(4-aminophenoxy)biphenyl (BAPB) or bis[4-(4-aminophenoxy)phenyl]sulfone (BAPS) is used as the residue of the other diamine component than ODA, flexibility of a polyimide to be manufactured may decrease since the residues of such diamines are a monomer including a rigid structure. Therefore, when the residue of such a diamine is mixed in an amount more than the residue of ODA (mixed in an amount of more than 50 mole %), a decrease in the flexibility caused by mixing the residue of other diamine component than ODA can be suppressed by reducing the mixture amount of PMDA which is the first acid component in the repeating unit represented by the formula (1) (e.g., less than 50 mole % of PMDA).

When the storage elastic modulus of the polyimide at 325° C. is less than 50 MPa, the film deforms easily due to a stress applied during a high temperature process such as welding and defects such as expansion occur. Therefore, the polyimide needs to have a storage elastic modulus of not less than 50 MPa.

Unless such characteristics are impaired, the polyimide used for the insulation layer in the invention may contain repeating units other than those represented by the formulas (1) and (2). That is, tetracarboxylic dianhydrides include, e.g., 3,3',4,4'-benzophenone-tetracarboxylic dianhydride (BTDA), 3,3',4,4'-diphenyl sulfone-tetracarboxylic dianhydride (DSDA), 4,4'-oxydiphthalic dianhydride (ODPA), 3,3',4,4'-biphenyltetracarboxylic dianhydride and 4,4'-(2,2-hexafluoroisopropylidene)diphthalic dianhydride (6FDA), etc. In addition, butanetetracarboxylic dianhydride, 5-(2,5-dioxotetrahydro-3-furanyl)-3-methyl-3-cyclohexene-1,2-dicarboxylic anhydride or alicyclic tetracarboxylic dianhydrides obtained by hydrogenating the above-mentioned tetracarboxylic dianhydrides, etc., may be concurrently used, if required.

In addition, polymer terminals may be capped in the polyimide constituting the insulation layer in the present embodiment. As a material used for capping, it is possible to use a compound containing acid anhydride or a compound containing amino group. The compound containing acid anhydride includes, e.g., phthalic anhydridem, 4-methylphthalic anhydride, 3-methylphthalic anhydride, 1,2-naphthalic anhydride, maleic anhydride, 2,3-naphthalenedicarboxylic anhydride, various fluorinated phthalic anhydrides, various brominated phthalic anhydrides, various chlorinated phthalic anhydrides, 2,3-anthracenedicarboxylic anhydride, 4-ethynylphthalic anhydride and 4-phenylethylphthalic anhydride, etc.

As the capping compound containing amino group, a compound containing one amino group can be selected and used.

In the insulated wire of the present embodiment, a film having high adhesion may be provided under the polyimide insulation layer of the present embodiment. This allows adhesion of the conductor to the insulation layer to be enhanced. The adhesion layer can be thin to the extent that does not inhibit flexibility or partial discharge resistance of the insulated wire. The thickness of the adhesion layer is preferably, e.g., 1 to 10 μm. By providing the adhesion layer, it is possible to improve adhesion of the polyimide insulation layer in the present embodiment to the conductor or to another layer constituting, together with the insulation layer, the insulated wire. The adhesion layer can be formed of, e.g., a resin such as polyimide, polyamide-imide or polyester-imide.

The insulation layer made of the polyimide and used in the present embodiment can be formed by, e.g., applying and baking the following insulating coating material on the conductor. That is, using a conventional method, the below-described insulating coating material in the form of polyamic acid is applied to the conductor and is baked in a furnace at, e.g., 350 to 500° C. for 1 o 2 minutes. This is repeated ten to twenty times to increase a film thickness, thereby forming the insulation layer.

In detail, the insulating coating material has a repeating unit represented by the following formula (9) and a repeating unit represented by the following formula (10), and is configured such that a molar ratio of a first acid component in the repeating unit represented by the formula (9) to a second acid component in the repeating unit represented by the formula (10) is within a range of 85:15 to 40:60 and R which is a residue of a diamine component is composed of a residue of 4,4'-diaminodiphenyl ether and a residue of a diamine selected from a group of diamines represented by the formulas (3) to (8). The insulating coating material has a storage elastic modulus of not less than 50 MPa at 325° C. after imidization by heat treatment, etc., and contains a polyamic acid.

(9)

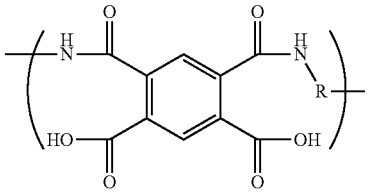

(10)

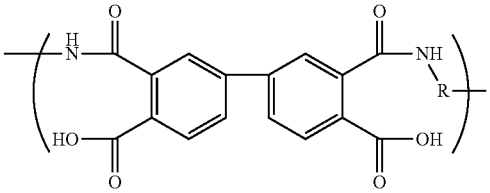

Coil

A coil in the present embodiment is formed using the above-mentioned insulated wire. The coil using the above-mentioned insulated wire is not specifically limited and can be manufactured by a general method.

EXAMPLES

The insulated wire in the invention will be described in more detail below with reference to Examples. It should be noted that the invention should not be construed to be limited by the following Examples.

Example 1

After dissolving 4,4'-diaminodiphenyl ether (ODA) and 4,4'-bis(4-aminophenoxy)biphenyl (BAPB) into N-methylpyrrolidone (NMP), pyromellitic dianhydride (PMDA) and 3,3',4,4'-biphenyltetracarboxylic dianhydride (s-BPDA) were dissolved therein and the mixture was stirred at room temperature for 12 hours, thereby obtaining a polyamic acid coating material having a mixture ratio of "PMDA:s-BPDA:ODA:BAPB=75:25:85:15". Dilution of the polyamic acid coating material was adjusted for coating workability. Using a conventional means, the obtained coating material was applied to a 0.8 mm-diameter copper wire and baked in a coating oven at 450° C. for 90 seconds. This was repeated fifteen times, thereby obtaining an insulated wire having a film thickness of 40 μm.

Example 2

Example 2 was the same as Example 1, except that the mixture ratio for the polyamic acid coating material was changed to "PMDA:s-BPDA:ODA:BAPB=50:50:50:50".

Example 3

After dissolving ODA and 1,3-bis(4-aminophenoxy)benzene (TPE-R) into NMP, PMDA and s-BPDA were dissolved therein and the mixture was stirred at room temperature for 12 hours, thereby obtaining a polyamic acid coating material having a mixture ratio of "PMDA:s-BPDA:ODA:TPE-R=75:25:50:50". Dilution of the polyamic acid coating material was adjusted for coating workability. Using a conventional means, the obtained coating material was applied to a 0.8 mm-diameter copper wire and baked in a coating oven at 450° C. for 90 seconds. This was repeated fifteen times, thereby obtaining an insulated wire having a film thickness of 40 μm.

Example 4

After dissolving ODA and bis[4-(4-aminophenoxy)phenyl]sulfone (BAPS) into NMP, PMDA and s-BPDA were dissolved therein and the mixture was stirred at room temperature for 12 hours, thereby obtaining a polyamic acid coating material having a mixture ratio of "PMDA:s-BPDA:ODA:BAPS=75:25:50:50". Dilution of the polyamic acid coating material was adjusted for coating workability. Using a conventional means, the obtained coating material was applied to a 0.8 mm-diameter copper wire and baked in a coating oven at 450° C. for 90 seconds. This was repeated fifteen times, thereby obtaining an insulated wire having a film thickness of 40 μm.

Example 5

After dissolving ODA and 2,2-bis[4-(4-aminophenoxy)phenyl]propane (BAPP) into NMP, PMDA and s-BPDA were dissolved therein and the mixture was stirred at room temperature for 12 hours, thereby obtaining a polyamic acid coating material having a mixture ratio of "PMDA:s-BPDA:ODA:BAPP=60:40:50:50". Dilution of the polyamic acid coating material was adjusted for coating workability. Using a conventional means, the obtained coating material was applied to a 0.8 mm-diameter copper wire and baked in a coating oven at 450° C. for 90 seconds. This was repeated fifteen times, thereby obtaining an insulated wire having a film thickness of 40 μm.

Example 6

Example 6 was the same as Example 1, except that the mixture ratio for the polyamic acid coating material was changed to "PMDA:s-BPDA:ODA:BAPB=40:60:25:75".

Example 7

Example 7 was the same as Example 5, except that the mixture ratio for the polyamic acid coating material was changed to "PMDA:s-BPDA:ODA:BAPP=85:15:25:75".

Example 8

Example 8 was the same as Example 4, except that the mixture ratio for the polyamic acid coating material was changed to "PMDA:s-BPDA:ODA:BAPS=50:50:99:1".

Example 9

Example 9 was the same as Example 5, except that the mixture ratio for the polyamic acid coating material was changed to "PMDA:s-BPDA:ODA:BAPP=85:15:99:1".

Example 10

Example 10 was the same as Example 3, except that the mixture ratio for the polyamic acid coating material was changed to "PMDA:s-BPDA:ODA:TPE-R=70:30:20:80".

Example 11

Example 11 was the same as Example 1, except that the mixture ratio for the polyamic acid coating material was changed to "PMDA:s-BPDA:ODA:BAPB=70:30:20:80".

Comparative Example 1

After dissolving ODA into NMP, PMDA was dissolved therein and the mixture was stirred under nitrogen at room temperature for 12 hours, thereby obtaining a polyamic acid coating material having a mixture ratio of "PMDA:ODA=100:100". The polyamic acid coating material was appropriately diluted with a solvent for coating workability. Using a conventional means, the obtained coating material was applied to a 0.8 mm-diameter copper wire and baked in a coating oven at 450° C. for 90 seconds. This was repeated fifteen times, thereby obtaining an insulated wire having a film thickness of 40 μm.

Comparative Example 2

After dissolving ODA into NMP, PMDA and s-BPDA were dissolved therein and the mixture was stirred under nitrogen at room temperature for 12 hours, thereby obtaining a polyamic acid coating material having a mixture ratio of "PMDA:s-BPDA:ODA=90:10:100". The polyamic acid coating material was appropriately diluted with a solvent for coating workability. Using a conventional means, the obtained coating material was applied to a 0.8 mm-diameter copper wire and baked in a coating oven at 450° C. for 90 seconds. This was repeated fifteen times, thereby obtaining an insulated wire having a film thickness of 40 μm.

Comparative Example 3

Comparative Example 3 was the same as Comparative Example 2, except that the mixture ratio for the polyamic acid coating material was changed to "PMDA:s-BPDA:ODA=30:70:100".

Comparative Example 4

After dissolving ODA and BAPP into NMP, PMDA and s-BPDA were dissolved therein and the mixture was stirred under nitrogen at room temperature for 12 hours, thereby obtaining a polyamic acid coating material having a mixture ratio of "PMDA:s-BPDA:ODA:BAPP=35:65:100:0". Dilution of the polyamic acid coating material was adjusted for coating workability. Using a conventional means, the obtained coating material was applied to a 0.8 mm-diameter copper wire and baked in a coating oven at 450° C. for 90 seconds. This was repeated fifteen times, thereby obtaining an insulated wire having a film thickness of 40 μm.

The following evaluation tests were conducted for the insulated wires obtained in Examples 1 to 11 and Comparative Example 1 to 4. Table 1 shows the result of the evaluation tests.

Storage Elastic Modulus

For the storage elastic modulus, viscoelasticity of a film made of the coating material was measured. The storage elastic modulus of not less than 50 MPa at 325° C. was evaluated as "○ (passed the test)" and less than 50 MPa was evaluated as "X (failed)".

Flexibility

For the flexibility, a sample was taken from the obtained insulated wire, was elongated by 20% or 30% in a longitudinal direction thereof and was then wound around a winding bar having the same outer diameter as the conductor. Then, presence of defects such as cracks or breakage on the insulation layer was observed by a microscope. The sample without cracks and breakage on the insulation layer after 30% elongation was evaluated as "◎ (excellent)", the sample without cracks and breakage on the insulation layer after 20% elongation was evaluated as "○ (passed the test)" and the sample with cracks or breakage after 20% elongation was evaluated as "X (failed)".

Partial Discharge Inception Voltage (PDIV)

The partial discharge inception voltage (PDIV) was measured by the following procedure. The obtained insulated wire was cut into a length of 500 mm and ten samples of twisted-pair insulated wires were made. Then, an end processed portion was formed by removing the insulation layer to a position of 10 mm from an edge. In the measurement, an electrode was connected to the end processed portion and voltage at 50 Hz was increased at a rate of 10 to 30 V/s in an atmosphere at 25° C. and humidity of 50% until reaching a level at which 10 μC of discharge occurs 50 times per second in the twisted-pair insulated wire. This was repeated three times and an average value of the three measurements was defined as a partial discharge inception voltage. The PDIV of not less than 900 Vp at a film thickness of 40 μm was evaluated as "○ (passed the test)" and less than 900 Vp was evaluated as "X (failed)".

Weldability

A test piece having a length of about 10 cm taken from the manufactured insulated wire was left in a thermostatic chamber at a temperature of 25° C. and humidity of 50% for 3 hours to make a moisture-absorbed test piece. After that, an insulating coating at an end portion of the moisture-absorbed test piece was removed about 5 mm from the tip and the end portion was welded by a TIG welding equipment under conditions at current of 80 A for 0.3 seconds. The appearance in this state was observed by an electronic microscope. The test piece of which insulating coating was not separated and foamed was evaluated as "○ (passed the test)" and the test piece of which insulating coating was separated or foamed was evaluated as "X (failed)".

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

TABLE 1

| | First acid component vs Second acid component | ODA vs Another diamine component | Storage elastic modulus | PDIV (Vp) at film thickness of 40 μm | | Weldability | Flexibility |
|---|---|---|---|---|---|---|---|
| Example 1 | 75:25 | 85:15 | ○ | 970 | ○ | ○ | ◎ |
| Example 2 | 50:50 | 50:50 | ○ | 990 | ○ | ○ | ◎ |
| Example 3 | 75:25 | 50:50 | ○ | 980 | ○ | ○ | ◎ |
| Example 4 | 75:25 | 50:50 | ○ | 960 | ○ | ○ | ◎ |
| Example 5 | 60:40 | 50:50 | ○ | 1005 | ○ | ○ | ◎ |
| Example 6 | 40:60 | 25:75 | ○ | 985 | ○ | ○ | ◎ |
| Example 7 | 85:15 | 25:75 | ○ | 1005 | ○ | ○ | ◎ |
| Example 8 | 50:50 | 99:1 | ○ | 965 | ○ | ○ | ◎ |
| Example 9 | 85:15 | 99:1 | ○ | 905 | ○ | ○ | ◎ |
| Example 10 | 70:30 | 20:80 | ○ | 975 | ○ | ○ | ○ |
| Example 11 | 70:30 | 20:80 | ○ | 985 | ○ | ○ | ○ |
| Comparative Example 1 | 100:0 | 100:0 | ○ | 875 | X | ○ | ◎ |
| Comparative Example 2 | 90:10 | 100:0 | X | 965 | ○ | X | ◎ |
| Comparative Example 3 | 30:70 | 100:0 | X | 955 | ○ | X | X |
| Comparative Example 4 | 35:65 | 100:0 | X | 940 | ○ | X | ◎ |

What is claimed is:

1. An insulated wire, comprising:

a conductor, and a polyimide insulation layer formed on an outer periphery of the conductor, wherein the insulation layer consists of a polyimide consisting of a repeating unit represented by the following formula (1) and a repeating unit represented by the following formula (2), wherein a first acid component in the repeating unit represented by the formula (1) and a second acid component in the repeating unit represented by the formula (2) are mixed in a molar ratio range of 85:15 to 40:60 as expressed by a molar ratio (the first acid component:the second acid component), wherein R as a residue of a diamine component in the formulas (1) and (2) comprises a residue of 4,4'-diaminodiphenyl ether (ODA) and a residue of one selected from the group consisting of diamines represented by the following formulas (6) and (8), and wherein the residue selected from the group consisting of formulas (6) and (8) is mixed in an amount of more than the residue of ODA, wherein multiple layers of polyamic acids of the first acid component of formula (1) and the second acid component of formula (2) are coated on the conductor and each layer is baked between coatings, and wherein a storage elastic modulus of the polyimide at 325° C. is not less than 50 MPa, and a partial discharge inception voltage (PDIV) at a film thickness of 40 μm of the polyimide insulation layer is not less than 960 Vp, (1)

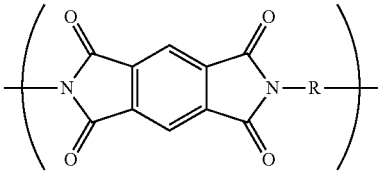

-continued (2)

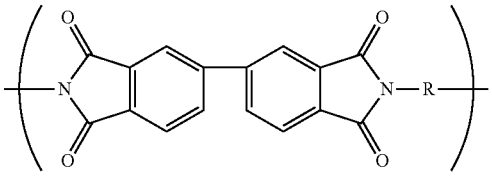

(3)

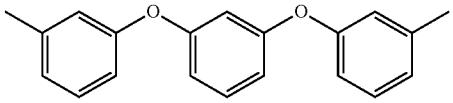

(4)

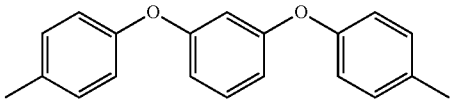

(5)

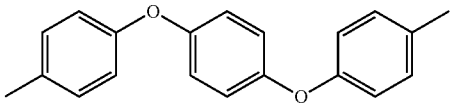

(6)

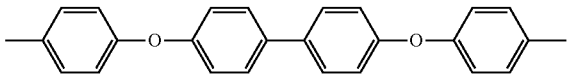

(7)

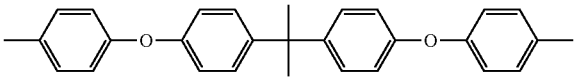

(8)

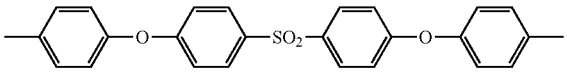

2. The insulated wire according to claim 1, wherein the residue of 4,4'-diaminodiphenyl ether and the residue of a diamine selected from the group consisting of the formulas (6) and (8) are mixed in a molar range of greater than 50 mole % of one of the formulas (6) and (8)), relative to the residue of ODA.

3. A coil comprising the insulated wire according to claim 1.

4. An insulated wire, comprising:

a conductor, and a polyimide insulation layer formed on an outer periphery of the conductor, wherein the insulation layer consists of a polyimide consisting of a repeating unit represented by the following formula (1) and a repeating unit represented by the following formula (2), wherein a first acid component in the repeating unit represented by the formula (1) and a second acid component in the repeating unit represented by the formula (2) are mixed in a molar ratio range of 85:15 to 40:60 as expressed by a molar ratio (the first acid component:the second acid component), wherein R as a residue of a diamine component in the formulas (1) and (2) comprises a residue of 4,4'-diaminodiphenyl ether (ODA) and a residue of one selected from the group consisting of diamines represented by the following formulas (6) and (8), and wherein multiple layers of polyamic acids of the first acid component formula (1) and the second acid component formula (2 are coated on the conductor and each layer is baked between coatings, and wherein a storage elastic modulus of the polyimide at 325° C. is not less than 50 MPa, and a partial discharge inception voltage (PDIV) at a film thickness of 40 μm of the polyimide insulation layer is not less than 960 Vp, (1)

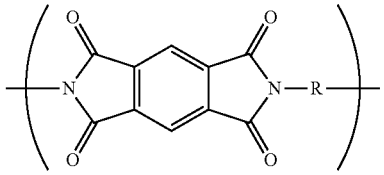

(2)

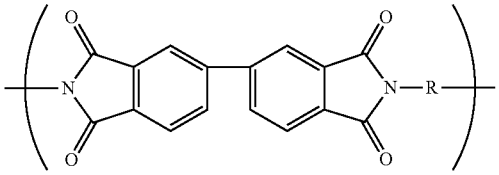

(3)

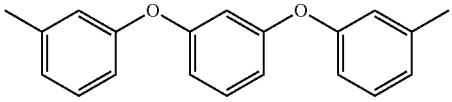

(4)

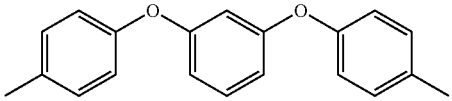

-continued (5)

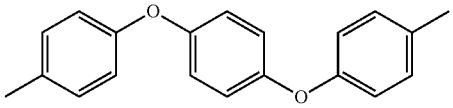

(6)

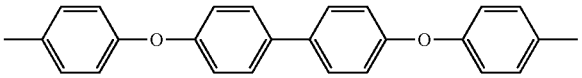

(7)

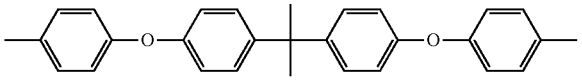

(8)

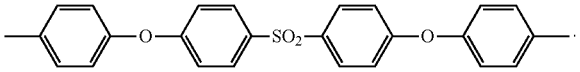

5. The insulated wire according to claim 1, wherein the residue of ODA and the residue of the diamine of formula (6) are mixed in a molar ratio of 85 mole % of formula (6) to 15 mole % ODA, and the molar ratio of the first acid component to the second acid component is 75 mole % to 25 mole %.

6. The insulated wire according to claim 1, wherein the residue of ODA and the residue of the diamine of formula (6) are mixed in a molar ratio of 80 mole % of formula (6) to 20 mole % ODA, and the molar ratio of the first acid component to the second acid component is 70 mole % to 30 mole %.

7. The insulated wire according to claim 4, wherein the residue of ODA and the residue of the diamine of formula (6) are mixed in a molar ratio of 50 mole % of formula (6) to 50 mole % ODA, and the molar ratio of the first acid component to the second acid component is 50 mole % to 50 mole %.

8. The insulated wire according to claim 4, wherein the residue of ODA and the residue of the diamine of formula (8) are mixed in a molar ratio of 50 mole % of formula (8) to 50 mole % ODA, and the molar ratio of the first acid component to the second acid component is 75 mole % to 25 mole %.

9. The insulated wire according to claim 4, wherein the residue of ODA and the residue of the diamine of formula (8) are mixed in a molar ratio of 1 mole % of formula (8) to 99 mole % ODA, and the molar ratio of the first acid component to the second acid component is 50 mole % to 50 mole %.

* * * * *